United States Patent [19]

Hollick

[11] 4,249,320

[45] Feb. 10, 1981

[54] MACHINE FOR STIFFENING AND FORMING SHEET MATERIAL

[75] Inventor: John G. Hollick, Beverly, Mass.

[73] Assignee: USM Corporation, Farmington, Conn.

[21] Appl. No.: 62,070

[22] Filed: Jul. 30, 1979

Related U.S. Application Data

[60] Division of Ser. No. 921,944, Jul. 5, 1978, which is a continuation-in-part of Ser. No. 806,559, Jun. 14, 1977.

[51] Int. Cl.[3] ..... A43B 13/42; A43D 0/00

[52] U.S. Cl. ..... 36/68; 12/146 D

[58] Field of Search ..... 36/68; 12/146 D

[56] References Cited

U.S. PATENT DOCUMENTS

| | | | |
|---|---|---|---|
| 2,552,638 | 5/1951 | Meltzer | 36/68 |
| 3,316,573 | 5/1967 | Chaplick et al. | 12/146 D |
| 3,393,461 | 7/1968 | Ryan et al. | 36/68 |
| 3,973,285 | 8/1976 | Babson et al. | 12/146 D |
| 4,127,910 | 12/1978 | Hollick | 12/146 D |

*Primary Examiner*—Patrick D. Lawson

*Attorney, Agent, or Firm*—Owen J. Meegan; Vincent A. White

[57] ABSTRACT

A machine for stiffening and forming a selected area of flexible sheet material, for instance an end portion of a shoe upper, comprises work support mechanism including a universal female preformer having work-accommodating dihedral surfaces, an applicator for depositing on a portion of the selected area a predetermined volume of molten resin substantially in proportion to that area, and a presser complemental to the cavity defined by said surfaces and relatively movable into and out of cooperative work-pressing relation with respect to the work support to spread the molten resin and impart appropriate thickness gradient thereto throughout the selected area whereby, upon cooling, it is formed three-dimensionally and stiffened a desired degree in different portions.

For forming-in-place end portions subsequently to be lasted, such as backparts of shoe uppers, pincers suitably control spreading and tensioning of the work and then relatively move with respect to the applicator to partially distribute the resin extruded in parallel arrangement within the area prior to shut-off of resin flow directed at an angle on the order of about 45° to the area. Thereupon, the applicator being retracted, the molten resin is fully distributed throughout the selected area by mechanism closing the dihedral surfaces normal to the adjacent presser thus avoiding wrinkling and/or scuffing of the shoe upper and disturbing the distribution, in thickness and laterally, of the still molten resin.

4 Claims, 11 Drawing Figures

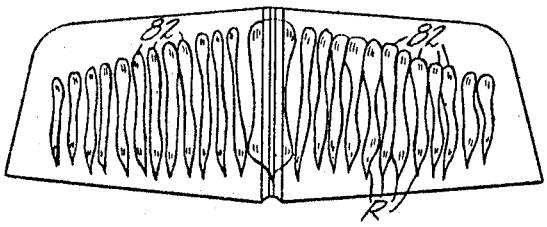
Fig. 6
Fig. 7
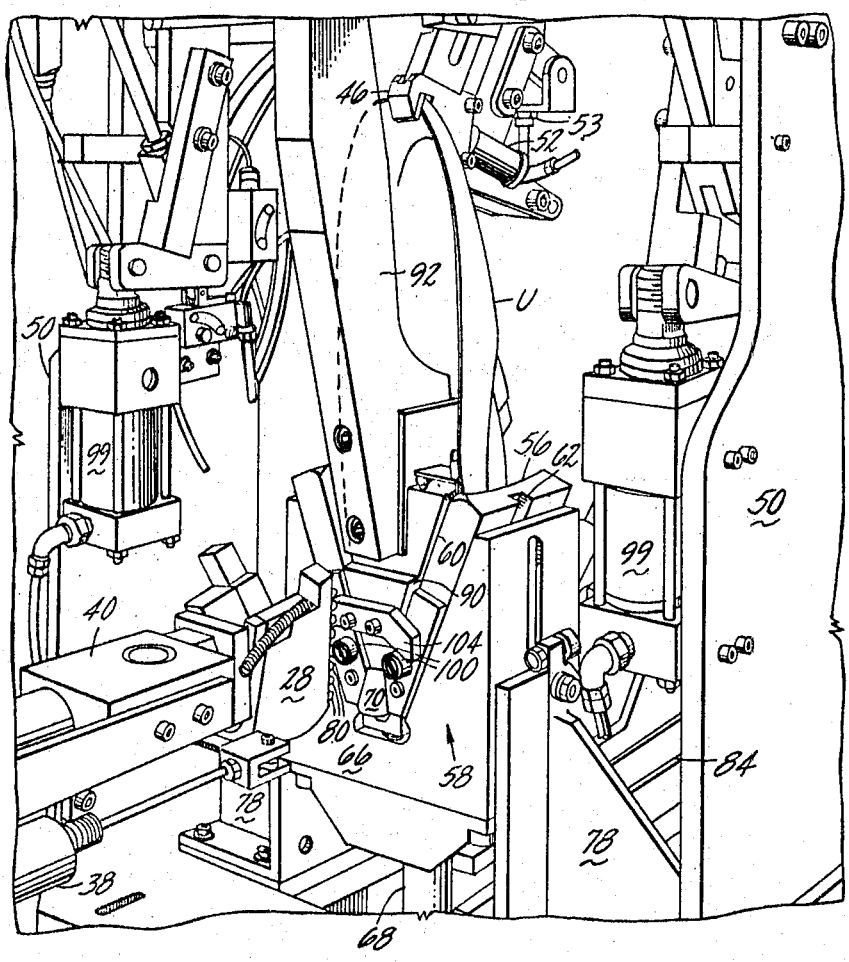

MACHINE FOR STIFFENING AND FORMING SHEET MATERIAL

CROSS-REFERENCE TO RELATED APPLICATION

This application is a division of Ser. No. 921,944, filed Jul. 5, 1978, which in turn is a continuation-in-part of U.S. Pat. application Ser. No. 806,559, filed Jun. 14, 1977, in the name of John G. Hollick.

BACKGROUND OF THE INVENTION

This invention relates to machines for pre-forming and stiffening flexible sheet material. It is particularly concerned with providing improved machines for forming and stiffening upper materials constituting the end portion of footwear. Accordingly, in one aspect, this invention is directed to implementation of the method for forming in situ thermoplastic counter portions as disclosed in the patent application above cited. It will be understood that usage of the present invention is not limited to footwear manufacture although this field will herein serve for purposes of illustration of the invention.

It has long been an objective in shoe making to shape and stiffen end portions of shoe uppers. As regards their backparts, for instance, counters have been provided for this purpose. They are expensive, costly to install, and necessitate maintaining an inventory of sizes and styles. Moreover, counters seldom truly conform for long to the last or foot shape, breaking down in service and perhaps consequently resulting in discomfort in wear and/or unsatisfactory appearance and shortened useful life. Toe portions of vamps have been stiffened, for example, by the use of thermoplastic applied as disclosed in U.S. Pat. Nos. 3,945,074 and 4,063,527 to mention only two of many.

In the prior art there have been attempts to inject stiffening adhesive between an extremity of a shoe upper and a liner or insert while placed over a last. In general such "one-shot" approaches have not been commercially acceptable largely for the reason that they lack the nice control required to produce the ultimate required shapes. The opposite sides of uppers alone may differ in thickness by as much as 0.040", and upper and lining combinations have thickness variation of up to about 0.060"; such non-uniformity raises very difficult if not impossible problems for a purely rigid mold shoe forming system. It will be appreciated, for instance, that in addition to catering for sizes, counter portions should be thicker in the back seam region and along the base region but then taper to a much reduced thickness along the top line of the upper and at the outer wing portions. The present invention accordingly recognizes the desirability of a two-stage solution, i.e. (1) introduction of thermoplastic resin to the preliminarily formed work with suitable distribution to be more completely effected by substantially universally applicable cooperative preforming and related implements, the main subject of the present invention, and (2) transition of the assembled upper, and preferably (though not necessarily) while the resin is still molten, for lasting in a suitable adjacent machine (for instance of the backpart molding type disclosed in U.S. Pat. No. 3,096,531) to impart final conforming shape to the stiffened upper placed on its last. Such two-stage making of shoes, as well as other products to be similarly stiffened and formed, is advantageous from a practical standpoint in that the first stage can be performed more quickly than the second and a cooling or dwell period is desirable in the latter to insure that deposited resin is not adversely redistributed. It is desirable that the upper "remember" its final conforming, but not its preforming in the initial stage.

SUMMARY OF THE INVENTION

In view of the foregoing it is an object of this invention to provide an improved machine for stiffening and forming flexible workpieces by depositing molten thermoplastic thereon, the machine to incorporate closeable preforming means of a universally applicable type for controlling further distribution of the thermoplastic.

A general object as regards the shoemaking art is to provide a machine for applying molten thermoplastic resin to a selected area of an upper off its last and then further distributing the resin in place upon a larger surface of the upper, including the selected area, to the desired, usually tapering, thickness in readiness for lasting.

Another and more specific object of the invention is to provide a highly productive machine for stiffening and preforming back portions of shoe uppers by application of molten resin in situ.

Yet another object of this invention is to provide an off-the-last backpart upper forming machine having a resin injection applicator and substantially universally applicable preform mechanism with cooperative upper controlling means for preparing the upper economically for lasting operations on its last.

To these ends the invention comprises the combination with conventional thermoplastic resin injection means of a novel applicator, work supporting means comprising universally applicable male and female preforming mechanism, and work spreading and tensioning means under the control of an operator for effecting distribution of the molten resin in cooperation with the forming mechanism. Preferably and as herein shown the illustrative machine comprises a pincer for seizing the upper at its toe end, and a pincer for gripping the upper at its heel end along the upper edge of its back seam, the work being thus suspended initially with its lining, if any, retracted to an out-of-the-way position to admit the nozzles of a molten resin applicator to a resin delivery position. With bottom edges of the upper suitably spaced in the cavity defined by the female former and equally tensioned, and the lining held open, injection is commenced while the top or toe pincer lifts the work to hold it against the applicator. Nozzle orifices, some of which may be blocked off when unneeded, preferably have their axes directed at an angle of about 45° to the adjacent work surfaces to be coated to prevent nozzles being fouled by deposited resin. During ejection of the predetermined charge of molten resin in adjacent globules, the back seam pincer is retracted relative to the applicator to elongate the coating heightwise of the shoe and substantially in equal volume on opposite sides of the back seam. Now the operator (or a wiper mechanism if and when preferred) may return the lining to its normal outspread counter pocket position against the upper and relatively actuate the male and female formers to more fully distribute the molten resin. The arrangement advantageously is such that the male former or presser initially is moved downwardly into a V-shaped cavity defined largely by dihedral sides of the female former. The sides may be hinged at the back seam locality by a foam insert or self-adjusting filler but this is not required. With the male presser positioned close to or in light contact with the lining, the dihedral sides are moved inwardly substantially normal to the adjacent presser surfaces thus avoiding wrinkling of the upper and adversely affecting distribution of the resin between the preforming members. While the toe pincer is tensioning the stock upwardly about the presser with a controlled pressure, closure of the formers is effected for a selected dwell. At expiry of the time delay the forming members separate and the pincers automatically release the upper flaccid with its distributed and still molten resin for transition to an adjacent machine such as the backpart assembling and molding machine referred to above for final shaping.

BRIEF DESCRIPTION OF THE DRAWINGS

The foregoing and other features of the invention, together with novel details and combinations of parts, will now be more particularly described with reference to the accompanying drawings of an illustrative backpart upper preforming machine wherein a selected portion of the upper is both stiffened and formed off-the-last, wherein:

FIG. 6 is a plan view showing on a larger scale a counter in flattened condition to illustrate its back seam and the plurality of elongated resin deposits in a symmetrical, central area prior to closure of the preformers;

FIG. 7 is a perspective view similar to FIG. 5, but at a next stage of the operating cycle wherein upper and lower formers have closed to further distribute the molten resin;

DESCRIPTION OF A PREFERRED EMBODIMENT

Figure 1:
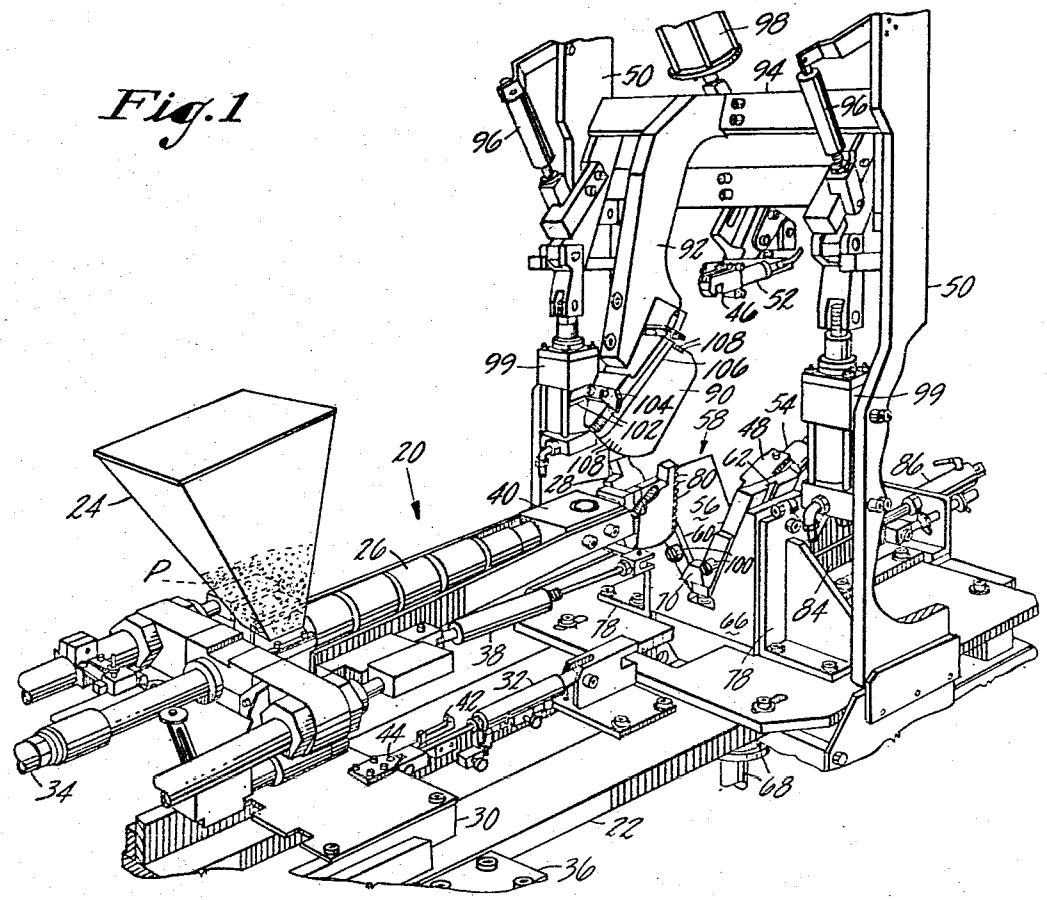
FIG. 1 is a perspective view of the machine, with portions broken away, and showing in inoperative position a largely conventional thermoplastic injection unit, an applicator, work supporting means in the form of a pair of cooperative pincers, and closeable V-shaped universal preforming means for redistributing the molten resin deposited by the applicator.
Figure 2:
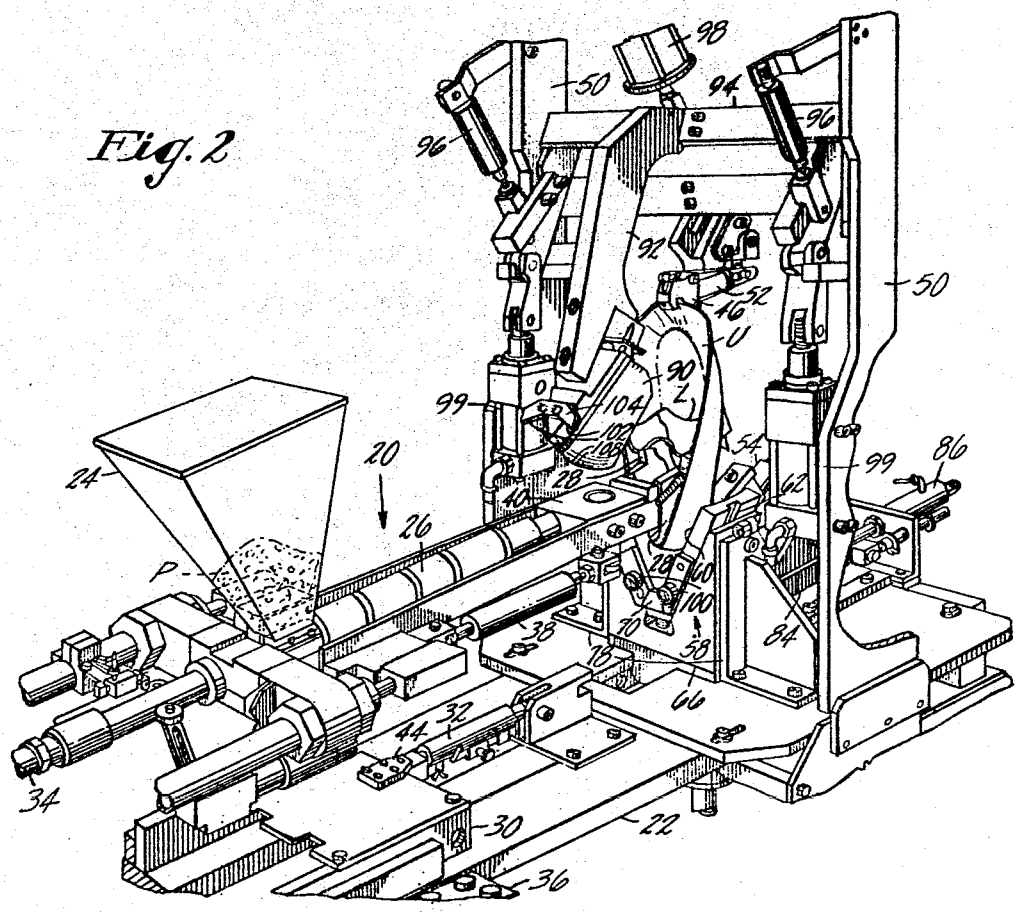
FIG. 2 is a view similar to FIG. 1 and showing the machine at a next stage wherein the work, a shoe upper, has been positioned and is receiving a charge of resin from the applicator.

Referring to FIGS. 1 and 2, an extruder-injector unit 20 of known type is mounted on a frame 22. The unit, briefly, includes a hopper 24 for receiving thermoplastic pellets P, for instance of a polyolefin such as a polyethylene, to be melted when fed into an extruder barrel 26. A heated applicator 28, hereinafter to be further described, is arranged on one end of the barrel to receive and emit a predetermined charge of the molten resin, designated R in FIGS. 5 and 6, when applied. As herein shown, the unit 20 is secured on a carriage 30 horizontally slidable on the frame and toward and from a resin delivery position by operation of a piston-cylinder device 32, its cylinder being affixed to the frame and its piston being connected to the carriage. The unit 20 comprises an injector cylinder 34 the piston rod of which is reciprocated axially three times per cycle of the machine to insure that a full predetermined charge of the pellets P is supplied into the injection cylinder. The arrangement is such that actuation of a start switch on a control panel 36 to effect operation of the injector cylinder 34 also pressurizes the cylinder 32 as indicated in the timing sequence shown in FIG. 11. Accordingly, a selected predetermined volume of molten resin appropriate to the size and configuration of the work to be stiffened and shaped will be available to be extruded from the applicator 28 when it has advanced (to the right as seen in FIG. 2) and a piston-cylinder device 38 (FIGS. 1, 2, 11) has been actuated to open a valve 40 controlling resin flow into the applicator. The device 38 is thus actuated by a control circuit including a switch 42 associated with the device 32 and arranged to be operated by an abutment 44 affixed to the carriage 30.

Figure 3:
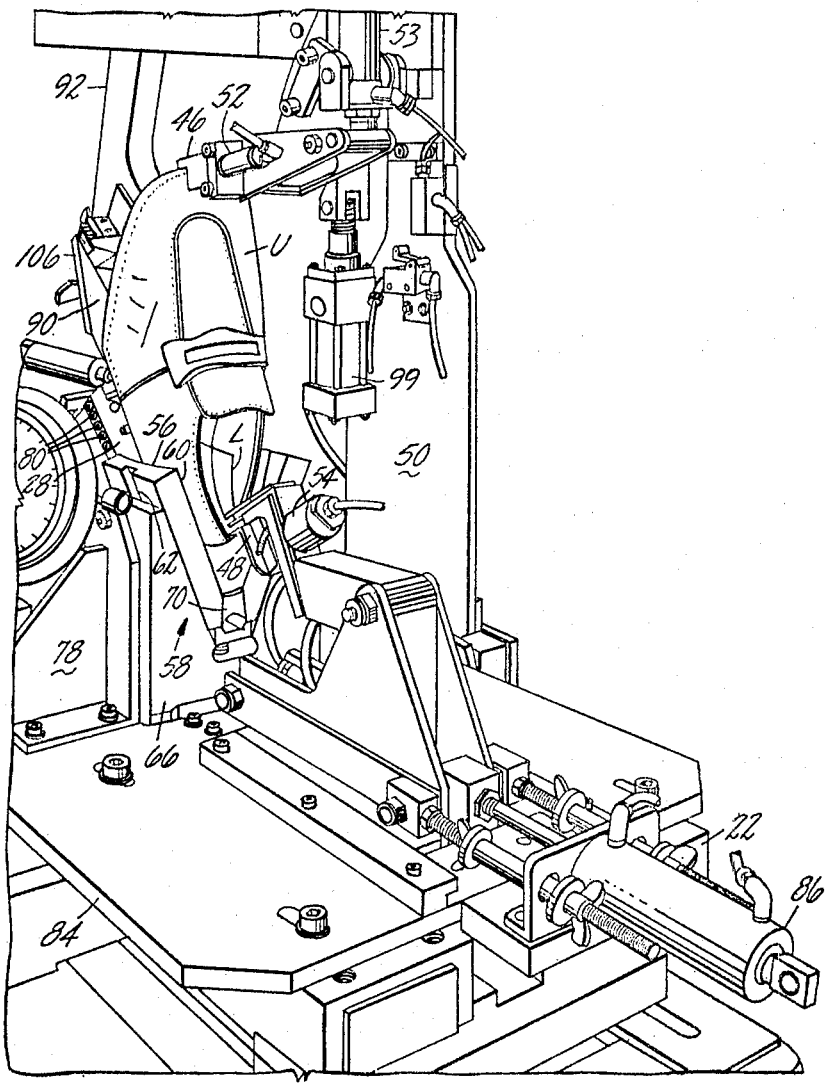
FIG. 3 is a perspective view taken from a different angle to show the work as positioned by the pincers and their actuating means.
Figure 4:
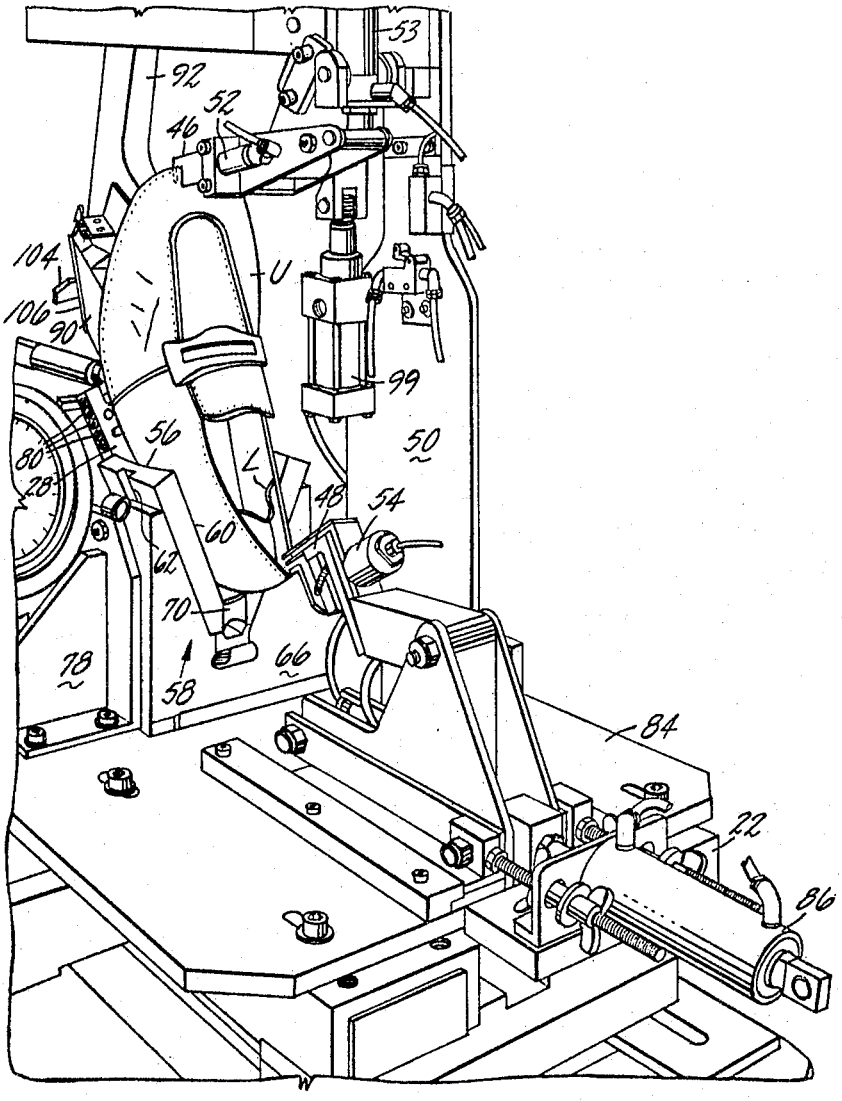
FIG. 4 is a view similar to FIG. 3 and illustrating retraction of the heel end from the applicator to spread the resin deposit heightwise of the upper.

It will of course be understood that an operator will not normally cause the resin R to be extruded until the work, in this instance a shoe upper U having a liner L, has been properly mounted in the machine as next explained. Assuming it is the heel end of the upper which is to be stiffened and preformed preparatory to heel end assembly and lasting, the upper is suspended as indicated in FIGS. 2–4. It will be noted that the work positioning means and technique differs in detail in several respects from that employed in the above-cited parent application Ser. No. 806,559 better to facilitate control of the work in the successive stages of the cycle subsequently to be described. In the present disclosure the upper U is suspended from, and tension therein controlled by, a top or toe pincer 46 (FIGS. 1–5 and 7) and a bottom or heel end pincer 48. Particulars of these pincers need not be fully detailed here, it being understood that they may substantially correspond with fluid pressure operated equivalents found in the shoe lasting art.

Figure 8:
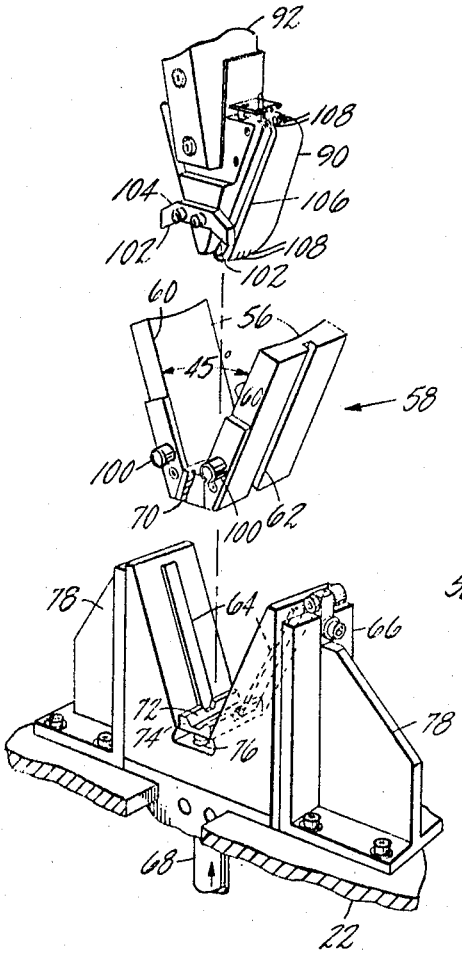
FIG. 8 is an exploded perspective view of the preforming members.

For supporting both of the pincers and pincer operating mechanism and work supporting means including universal preforming mechanism later described, parallel uprights 50,50 are secured on the frame 22. The toe pincer 46 is closeable to grip the upper U at the will of the operator (by actuation of a second treadle, for instance, a first treadle controlling a limit valve (not shown) and fluid pressure to the pincer 48 as indicated in FIG. 11 by means of piston-cylinder device 52 (FIGS. 1–4)), the toe extremity preferably being notched or bearing suitable indicia to enable the operator conveniently to position the work in the jaws of the pincer 46 prior to their closure. It will be understood that the pincer 46 will have been positioned initially to properly accommodate the size of the particular work being processed. Longitudinal tensioning of the upper by means of the pincer 46 is controlled by actuation of a piston-cylinder device 53 (FIGS. 3, 4, 7). For most work it is generally preferred that first the back seam adjacent to its upper edge be inserted into the bottom pincer 48 against a stop (not shown) therein, as indicated in FIG. 4, and then, after pulling the bottom pincer upwardly by means of the upper U, inserting the toe of the vamp into the open toe pincer 46 before causing its closure. The timing shown in the chart of FIG. 11 indicates closure of the pincer 48 by operation of the first treadle (not shown) prior to closure of the toe pincer 46 by actuation of the second treadle (also not shown), but this may, for some work, be a matter of choice left to the operator. Closure of the pincer 48 is controlled by a piston-cylinder device 54. It is important that the operator ascertain at this stage that the supported upper be positioned with its bottom edges symmetrically disposed within the cavity defined by dihedral inner surfaces 56, 56 of a female, universal type outside preformer generally designated 58 (FIGS. 1–5, 7–10). The bottom edges should be equally tensioned on opposite sides of the back seam. The preformer sides 56, 56 are slightly concave heightwise of the upper U and disposed with an included angle of from 15°–75° more usually in the range of 30°–60°, and herein shown as about 45°. Concavity of the surfaces 56, 56 about an axis substantially parallel to lengthwise work-engaging elements or edges such as at 60 of the outside former has a radius on the order of about eight inches. The preformer 58 has on its outer sides a kerf 62 arranged to slidably receive, respectively, a land or ridge 64 (FIG. 8) formed on the inside of an internally V-shaped block 66. The latter is movable heightwise by a piston-cylinder device 68 at a subsequent point in the cylce referred to later. As shown in FIG. 8, a keystone-shaped resilient member 70, of rubber for instance, is disposed at the bottom vertex of the forming cavity and preferably rests in a channel 72 formed in a bight or piece 74 yieldably supported on springs 76, 76 confined in bores of the block 66. Angle guides 78 bolted to the frame 22 are slidably engageable with outer side walls of the vertically movable block 66 which is in its down or inoperative position in the stages depicted in FIGS. 1–5.

Figure 5:
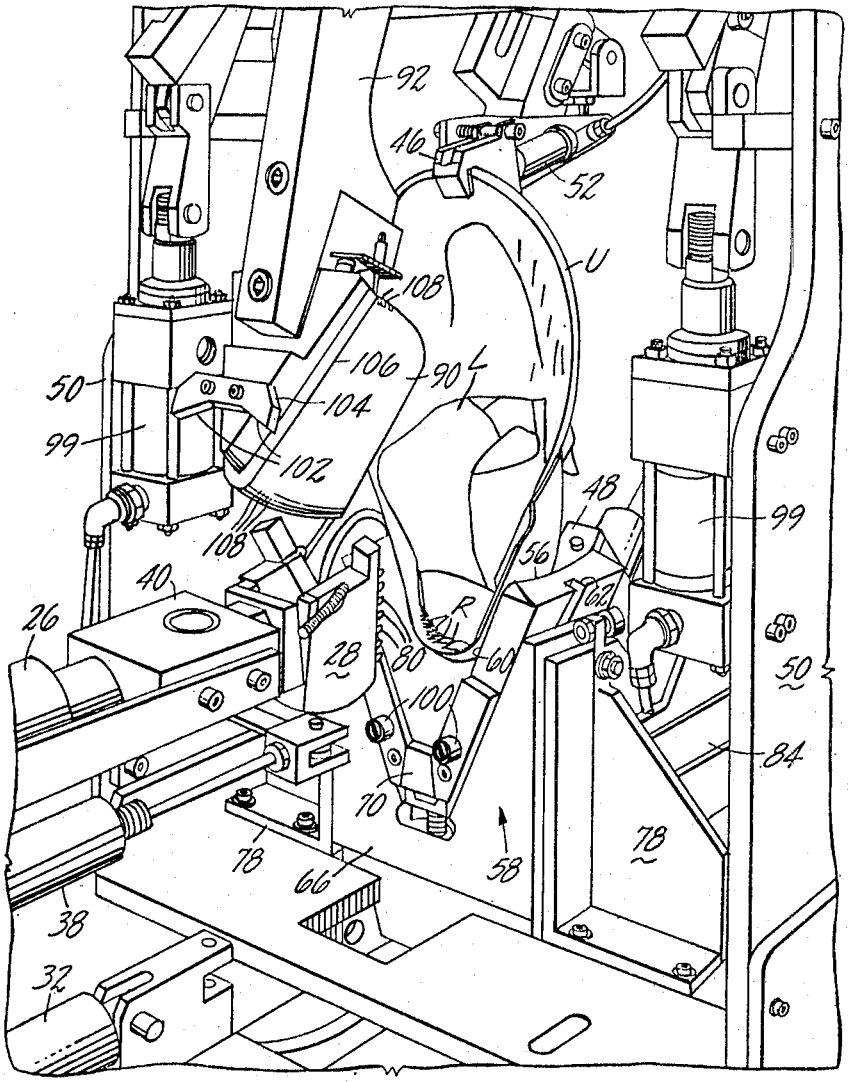
FIG. 5 is a perspective view similar to a portion of FIG. 2 but on a larger scale to show the applicator retracted from the upper.

With the work suspended as above described the operator will hold the upper lining L, if any, retracted to an out-of-the-way position as shown in FIG. 2. He advances the applicator 28 and upward movement of the toe pincer produces contact or near contact positions of the nozzles 80 with the inside back of the upper to extrude the resin R for deposit in thick, discrete bodies 82. These are emitted, one from each unblocked nozzle 80, onto the counter of the backpart in thicknesses usually varying from about $\frac{1}{8}''$ to $\frac{3}{8}''$, the greater thickness usually being in the locality of the back seam as indicated in FIGS. 5 and 6. The nozzles are disposed in a substantially V-shaped configuration, each having its axis directed outwardly to intersect the surface of the counter portion to be coated with an angle of incidence preferably of about 45° but generally acceptable within from about 30° to 60°. This arrangement prevents the deposited resin from "backing up" and sticking to the nozzles, instead of the upper upon withdrawal of the distributor body. For suitably adjusting the applicator 28 to accommodate smaller workpieces, it will be understood that short pins (not shown), or the equivalent, may be thrust into one or more of the wing nozzles to block their resin flow. Also means may be provided for retarding relative movement of the applicator heightwise of the upper at the beginning and end of resin application to increase resin thickness in those localities if so desired.

In the course of depositing the molten resin R, which commences at localities in varying extent from the top line of the counter as shown in FIG. 6, a carriage 84 (FIGS. 3, 4 and 11) mounting the bottom pincer 48 is automatically retracted to withdraw the upper backpart away from the applicator 28 thus to extend spreading of the bodies 82 heightwise of the upper. This is accomplished by a double-acting piston-cylinder device 86 operatively connected to the carriage and aids in keeping the backpart wrinkle-free. The extruder cylinder 26 bottoms and resin flow is terminated prior to the tapering ends of the bodies 82 extending to the bottom margin of the counter. It has been found from shoe making experience that the preliminary molten resin distribution pattern and its substantially symmetric arrangement on the work as illustrated in FIG. 6, is conducive to the desired ultimate distribution of the stiffening material to be attained in the sequential operations about to be described. Size of the blobs deposited adjacent the upper margin of the upper is controlled by the start of nozzle retraction relative to the commencement of extrusion. The diameters of intermediate portions of the blobs is controlled by the rate of nozzle retraction relative to the rate of resin extrusion. The terminal bulbous shape is controlled by the amount of extrusion after nozzle retraction ceases. As FIG. 11 shows, the toe pincer 46 will preferably have exerted, during the resin depositing, some upward relatively light tensioning of the upper to draw its backpart snugly about the applicator. Upon completion of the normal ejection cycle, a switch will be actuated to lower the toe pincer 46 after a time delay in which the applicator 28 retracts from the work.

Figure 9:
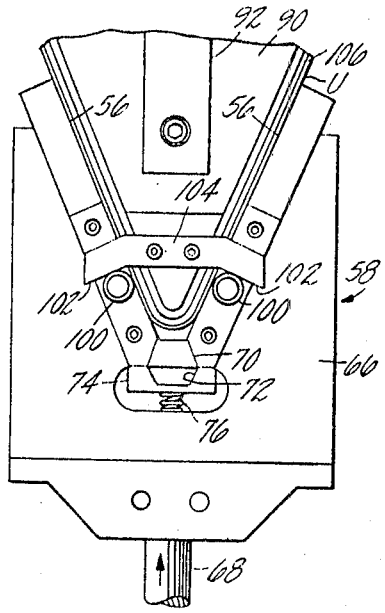
FIG. 9 is a view in elevation showing the fully lowered male former and the raised female former prior to closure.
Figure 10:
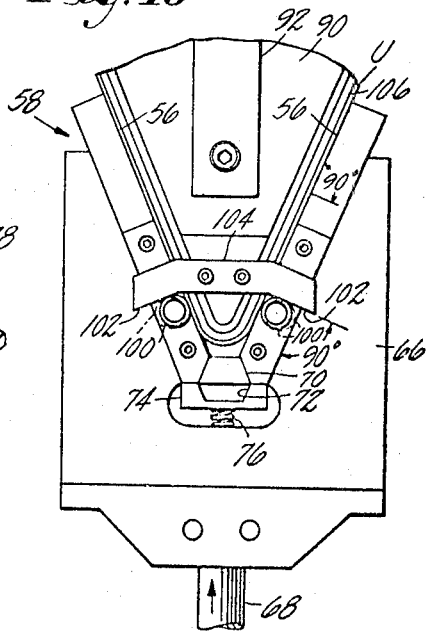
FIG. 10 is a view similar to FIG. 9 and illustrating cam actuation of the sides of the female preformer in a direction normal to the presser.
Figure 11:
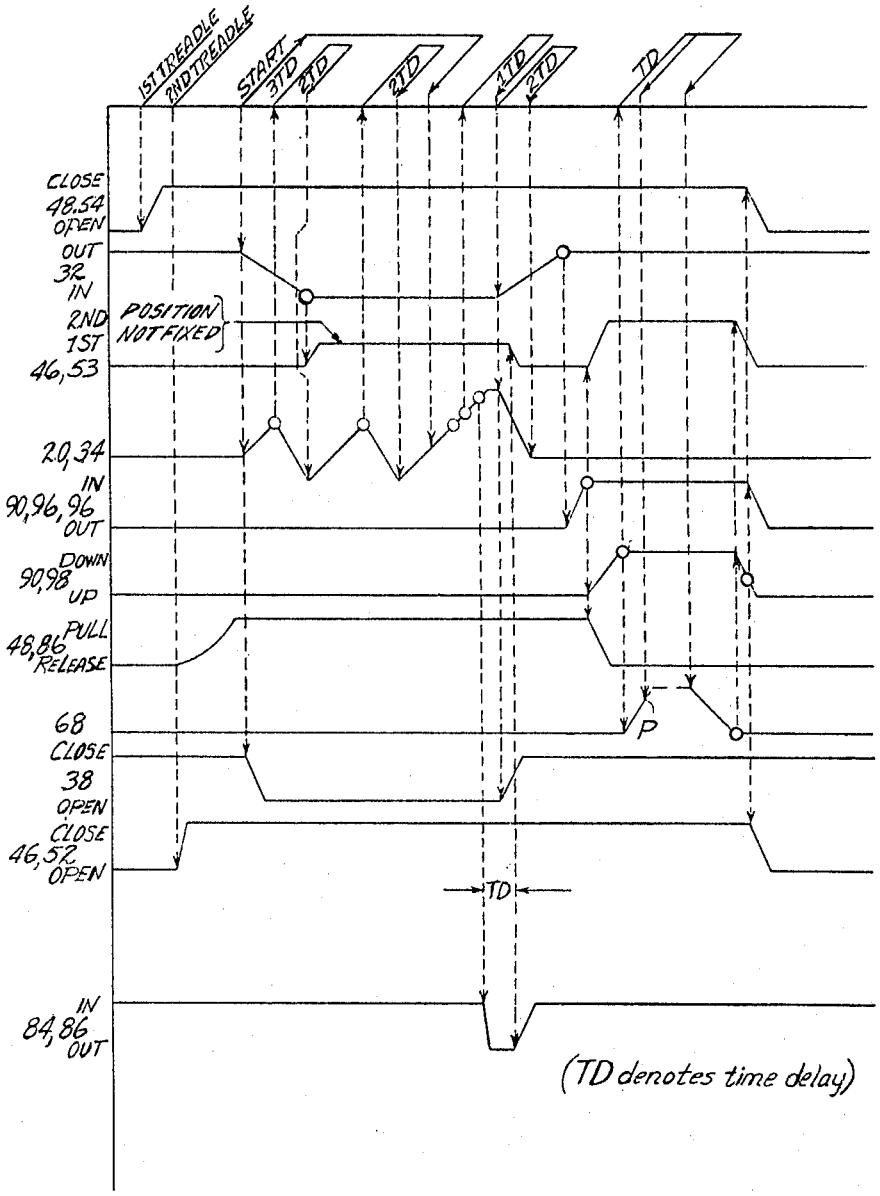
FIG. 11 is a representative timing chart for one cycle of the machine.

The operator now restores the lining L to its normal position in the upper and thereupon actuates a switch to lower an inside presser or male former 90 from its inoperative position shown in FIGS. 1, 2 and 5 to its operative relation with the upper as illustrated in FIGS. 7, 9 and 10. It will be understood that alternate mechanism for this purpose may differ greatly in detail. As herein shown the presser 90 is given a two-part motion, first to swing the presser about an axis extending above the upper and widthwise thereof, and then to force it downwardly into close proximity with the backpart of the upper in its forming cavity. For this purpose the presser 90, which corresponds substantially to the configuration defined by the surfaces 56, is detachably suspended from an arm 92 carried centrally by a cross arm 94 and actuated by associated linkage connected to its opposite ends. For insuring tapered thickness and diminishing stiffness away from the back seam locality, the dihedral angle of the presser 90 may be roughly on the order of from 0° to 3° greater than that defined by the V-surfaces 56, 56. The arrangement is such that a piston-cylinder device 96 operatively connected to each end of the cross arm swings the presser 90 from its inclined inoperative position shown in FIG. 5 to a vertical position shown in FIG. 7 wherein the presser is close to but above the work in the forming cavity. Thereupon a piston-cylinder device 98 (FIGS. 1, 2) operates, as indicated in FIG. 11, to force the press directly downward to position the exterior surface of the presser just above the inside counter (or equivalent) surface of the upper backpart. Simultaneously with this final lowering of the presser 90, the bottom pincer 48 remains engaged with the back seam locality. It may be mentioned that in the particular arrangement shown a pair of constant pressure air cylinders 99, 99 (FIGS. 1, 2) serve to aid in effecting upward return motion of the presser 90 near the end of an operation cycle.

At this stage completion of the descent of the presser 90 actuates a switch which causes operation of mechanism to do two things: (1) the toe pincer 46, while still gripping the toe margin, is moved upwardly under a controlled pressure which may be different (usually higher) than that for previously tensioning the upper longitudinally, and (2) the device 68 is energized to move the block 66 upwardly for the final preforming operation. In this latter resin spreading function it is sometimes preferred to effect raising of the block 66 with a two-speed technique, the faster raising occurring first and with full line pressure up to the point P in FIG. 11. It is important, of course, to accomplish the last phase of stiffening and preforming without wrinkling or scuffing the upper, yet completing distribution of the molten resin R throughout the backpart while insuring that, as thus distributed, the resin will have an appropriate tapering thickness from the thicker back seam area to the thinner marginal areas and at the wing extremities. As the block 66 is moved upwardly for this purpose as indicated in FIGS. 9 and 10, a pair of rolls 100, 100 mounted one on each of corresponding edge portions of the preformer 58 is disposed to engage cam faces 102, 102 respectively of cam 104 secured to the presser 90. The faces 102 each extend substantially 90° to the adjacent dihedral surface 56. Consequently the reaction forces of the roll and cam engagements as the preformer 58 is urged upwardly serve to move the rolls inwardly as indicated in FIG. 10 and to shift the preformer surfaces 56 inwardly and, importantly, in a direction substantially normal to the upper backpart to effect the completed resin distribution without risk of marring the upper as the preforming cavity is closed on the presser 90. Diagonal wrinkles near the top line of an upper, for instance, is an example of marring due to longitudinal shear between the upper, resin, and lining. The arrangement specifically of the V-shaped of the unlasted quarters joined by a back seam is of particular significance since it enables substantially universal accommodation of the short radii of curvature encountered in backpart extremities.

While for some work the presser and/or the preformer 58 may not need to be fitted with sealing means to retain the molten resin R within desired bounds on the selected work area to be stiffened, it is generally necessary (or at least desirable) to detachably mount a sealing strip 106 of suitable material on the presser and customarily in alignment with its bottom edge. The strip assures a clean bottom edge and prevents subsequent wiping of the resin into a lasting cement. The strip 106 may for instance, be of silicone-treated foam rubber backed by a thin metal band which is anchored at its upper ends and extends in selected ones of a series of grooves 108 spaced heightwise of the presser to position the strip parallel to the bottom edge of the presser. Movement of the preformer 58 into its cavity closing relation to the presser 90 initiates a controlled time delay to complete the spreading and joining of discrete hot plastic bodies R. The delay and pressure are adjusted so that lowering of the preformer 58 starts practically coincident with buildup to selected ram pressure. Longer dwells may cause the resin to creep outwardly with a "cold front" that effects insufficient bonding. When the delay runs out, the preformer 58 is lowered and, on bottoming, lowering of the toe pincer 46 and raising of the presser 90 are initiated. Thereupon the top and bottom pincers are caused to release the upper for transfer, while the resin R is at least partly molten, into the backpart assembling and lasting machine (or other forming machine) wherein the upper will be mounted on its last for final forming.

Operation of the illustrative machine for preforming off-the-last a selected area, for instance the backpart of an upper, in a typical cycle will now be briefly reviewed. It is to be appreciated that the technique practiced by the machine recognizes that follow-on or final upper forming to the contours of a last will desirably be performed in a lasting machine. Hence, the deposits of hot thermoplastic resin provided by the present machine are of substantial initial thickness better to retain their formable condition for the required operating cycles of both machines. The technique may be aided by provision of a controller for suitably regulating temperature of the formers. For simplicity of description the lining retraction from normal position and its subsequent return after the depositing of the resin are herein assumed to be done manually.

The toe pincer being adjusted fore, aft and heightwise for the size and positioning of the upper to be stiffened and preformed in its backpart, and the unit 20 being adjusted (as by pre-weighing each charge and operating at fixed intervals) for the volume of hot melt resin R desired to be extruded from the applicator 28, an operator inserts the back seam into the bottom pincer. Another preliminary is to adjust the position of the sealing strip 106 heightwise of the upper if needed for a particular size. Then, pulling the now-closed bottom pincer upwardly by the upper, he inserts the toe end margin into the toe pincer, preferably being guided by a notch preformed in the vamp. As shown in FIG. 11, a second treadle (treadle not shown, except in FIG. 11) is actuated to close the toe pincer 46 and retract the back seam pincer 48 to tension the upper lengthwise. Correct positioning of the upper in the pincers prior to resin deposition and preforming is important as above mentioned. Though not herein shown, it may for some work be desirable to provide a pair of auxiliary side pincers for seizing the upper at spaced points on opposite sides of the back seam pincer and along the top line of the upper thus to spread the work and exert a small, equalized tension heightwise of the upper for positioning its bottom edges relative to the operating path of the preformer 58. Such auxiliary side pincers may also facilitate entry of the applicator.

The next stage is to actuate the extruder unit 20, the applicator 28 depositing molten resin in spaced, thick blobs 82, preferably in symmetrical relation relative to the top line as shown in FIG. 6. In FIG. 11, the designation "TD" indicates usually preferred "time delay" intervals in the cycle. When the applicator 28 has entered the backpart "pocket", the toe pincer lifts the upper to urge the backpart lightly against the periphery of the applicator. It will be observed that the back seam pincer 48 is retracted by its carriage 84 and actuated piston-cylinder device 86 during resin injection and applicator retraction, thereby elongating the resin pattern heightwise of the upper. The depositing is terminated within the selected area ultimately to be stiffened and formed. Heaviest coating preferably occurs along the back seam. At the end of extrusion the toe pincer is lowered during applicator retraction. The preforming, first by tensioning the stock by pincer movement and then by closure of the presser 90 and the preformer 58 as will be described, is effective to thereafter diminish the resin thickness taperingly toward outer edges of the backpart and toward the ends or outer wings thereof. As has been noted the resin R is applied to the work while suspended and with its lining, if any, removed to an out-of-the-way position. The angular incidence of the nozzles to the backpart, preferably about 45° prevents their fouling and aids in resin deposition on the work.

After retraction of the applicator from the upper, the operator pushes the backpart lining downwardly to restore it to its normal position, and then causes the presser 90 to operate, in this instance performing a downward swinging effected by the devices 96, followed by vertical descent into the backpart pocket and into light contact or near contact with the restored backpart lining L as caused by the device 98. A limit valve (not shown) is thereupon effective to: (1) cause the toe pincer 46 to raise thereby tensioning the backpart under controlled pressure against the presser 90, and (2) actuate the piston-cylinder device 68 to lift the preformer 58 by vertically elevating the block 66, either with single or dual speed approach. The dual speed is indicated in FIG. 11 wherein the slower, less powerful forming force follows beyond the point P. The dihedral sides 56, 56 of the preformer 58 are thereupon caused to close upon the backpart and adjacent side surfaces of the presser 90. Importantly, relative closing motion of the sides 56 is effected substantially normal to the work by reason of the rolls 100 respectively engaging the cam faces 102. As indicated in FIG. 10, the rolls 100 are thus moved inwardly to shift the sides 56 inwardly to a force balance position and at substantially right angles to each of the dihedral sides S of the presser 90. This lack of relative sliding of the preformers with the work avoids scuffing the work or wrinkling it. It also enables the short curvature at the back seam locality to be imparted to the work as desired. The bight or piece 74 is not invariably required, though it appears to be vital when dealing with leathers where the pincer pull required to contain the resin under pressure would overstretch the leather. At expiration of a time delay wherein the inwardly moved sides 56 have been closed on the presser 90, distribution of the molten resin R between the lining L and the backpart of the upper will have been completed throughout the area to be stiffened and with thickness tapering to assure the degree of ultimate stiffness desired in the different portions. Accordingly the preformer 58 is lowered and, in response thereto, the toe pincer 46 and presser 90 are raised. This signals for release of the upper from the pincers 46 and 48 whereupon the upper can promptly be presented to a heel end lasting machine while the resin R is still sufficiently molten for final backpart forming and coincidental lasting.

It will be appreciated that the sealing strip 106 will have been positioned heightwise of the upper on the presser 90 so as to assure that the outline of the fully distributed resin R is not only thinner adjacent to the top line, and hence of reduced stiffness, but also less visible in the finished shoe. Temperature selection for melting the polyolefin used is controlled to eliminate "strings" during depositing of the resin, and the pressure required for effecting distribution of the plastic can remain essentially constant throughout usage of the V-preformers 58, 90. For resins tending to harden too rapidly, means may be introduced for heating the uppers and/or the formers. Generally, no seals are needed at the wing ends, and a top seal to keep the resin confined below the top line is optional.

It will be understood from the foregoing that the invention provides a versatile machine to in situ forming and stiffening the end portions of workpieces such as uppers.

What is claimed is:

1. a new article of commerce comprising a shoe counter having bottom and top margins and a backseam centrally disposed and extending between the margins, and a plurality of elongated resin deposits extending generally parallel to the backseam on one side of the counter, said deposits symmetrically terminating short of the top edge.

2. The article of commerce according to claim 1 wherein the resin deposits have one end with a generally drawn taper and another end terminating in a bulbous shape.

3. The article of commerce according to claims 1 or 2 wherein the resin deposits have bulbous portions adjacent to the bottom margin and drawn tapers against the top margins.

4. The article of commerce according to claims 1 or 2 wherein the thickness of each of the resin deposits is substantially the same.

* * * * *